US006073463A

United States Patent [19]

Espie

[11] Patent Number: 6,073,463

[45] Date of Patent: Jun. 13, 2000

[54] OPERATION OF A CRYOGENIC AIR SEPARATION UNIT WHICH INTERMITTENTLY USES AIR FEED AS THE REPRESSURIZATION GAS FOR A TWO BED PSA SYSTEM

[75] Inventor: David Miller Espie, Lansdale, Pa.

[73] Assignee: Air Products and Chemicals, Inc., Allentown, Pa.

[21] Appl. No.: 09/169,224

[22] Filed: Oct. 9, 1998

[51] Int. Cl.[7] ..... F25J 3/04

[52] U.S. Cl. ..... 62/657; 62/644

[58] Field of Search ..... 62/641, 644, 656, 62/909, 637

[56] References Cited

U.S. PATENT DOCUMENTS

| | | | |
|---|---|---|---|
| 4,251,248 | 2/1981 | Iyoki et al. | 62/656 |
| 5,406,800 | 4/1995 | Bonaquist | 62/656 |
| 5,560,763 | 10/1996 | Kumar | 95/98 |

OTHER PUBLICATIONS

Megan, et al. of Praxair, Inc. "Dynamic Study of Air Flow Disturbances on a Cryogenic Air Separation Plant" 1995 AICHE.

*Primary Examiner*—William Doerrler
*Attorney, Agent, or Firm*—Robert J. Wolff

[57] ABSTRACT

The present invention concerns a cryogenic air separation process which intermittently diverts a portion of the air feed as repressurization gas for a front-end two bed pressure swing adsorption adsorption system which system is used to remove impurities from the air feed. In particular, the present invention is an improvement to said process for at least partially eliminating reductions in the purity of the product streams from the air separation unit caused by the intermittent diversions of the air feed as repressurization gas. The improvement comprises reducing the flow of both the nitrogen-enriched waste stream and the crude liquid oxygen stream from the air separation unit during those intermittent periods when repressurization gas is required in the pressure swing adsorption system.

5 Claims, 2 Drawing Sheets

OPERATION OF A CRYOGENIC AIR SEPARATION UNIT WHICH INTERMITTENTLY USES AIR FEED AS THE REPRESSURIZATION GAS FOR A TWO BED PSA SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

In a cryogenic air separation unit, the carbon dioxide and water vapor must be removed from the compressed air prior to entering the cryogenic portion of the plant. The carbon dioxide and water vapor can be removed by a variety of methods, but is typically removed in an adsorption process. This adsorption process may be either temperature swing or pressure swing. Pressure swing adsorption (PSA) systems use either two or three bed cycles. A typical two bed adsorption cycle is shown below where "Depress" stands for depressurization and "Repress" stands for repressurization:

| | | | | | | |
|---|---|---|---|---|---|---|
| Bed A | Adsorption | | | Depress | Purge | Repress |
| Bed B | Depress | Purge | Repress | Adsorption | | |

The primary operational problem for a two bed PSA system is the requirement that the off-line bed be repressurized from the clean air stream prior to the bed switch. This causes a temporary decrease in the air flow to the air separation unit of typically between 5–15% of the main air compressor flow for a period lasting typically between 3–5 minutes.

In most plants, the main air compressor does not have sufficient capacity to supply the extra air required to repressurize the off-line bed without impacting the flow of air to the air separation unit. For a PSA system with cycle times of 1 minute for depressurization, 10 minutes for purging, 3 minutes for repressurization and a peak repressurization flow of 10% of the air flow, the air flow to the air separation unit as a function of time will be as shown in FIG. 1. As can be seen in FIG. 1, a portion of the air flow to the air separation unit is diverted every eleven minutes for a period lasting three minutes and, when diverted, constitutes 10% of the total impurity-deleted air feed at the beginning of such three minute period, gradually falling to 0% at the end of such three minute period.

The decrease in air flow to the air separation unit causes a disturbance to the purities within the lower pressure column and may cause product purities to violate their respective purity specifications. Furthermore, for plants with an argon sidearm column for argon purification, there is a significant risk of increased nitrogen in the feed to the sidearm column which can indirectly cause a trip of that column.

Air separation units with early implementations of two bed PSA systems were run at reduced recovery. For example in a 1995 AICHE paper by Megan et al. of Praxair, Inc.

entitled "Dynamic Study Of Air Flow Disturbances On A cryogenic Air Separation Plant, the impact of two bed disturbances was discussed and was solved by running the air separation unit with higher purity product streams than required, to allow for dips in purity that occurred because of a repressurization step. This reduced the recovery of the air separation unit along with increasing the power costs per unit of production.

The three bed PSA cycle was specifically developed to minimize the repressurization disturbance by continually repressurizing one of the three beds. This has been patented by Kumar and assigned to The BOC Group, Inc. as U.S. Pat. No. 5,560,763. The operational benefit of the third bed comes with a significant capital cost however. The penalty associated with a third bed and the associated piping and valve costs can be as much as $500,000.00 on a large plant.

U.S. Pat. No. 5,406,800 by Bonaquist and assigned to Praxair Technology, Inc. teaches using the high pressure and/or other column sumps to maintain column purities in response to load following where changes in the product flow from the air separation unit are desired. Contrast this with the goal of the present invention where the product flow and the product purities from the air separation unit are desired to be constant.

BRIEF SUMMARY OF THE INVENTION

The present invention concerns a cryogenic air separation process which intermittently diverts a portion of the air feed as repressurization gas for a front-end two bed pressure swing adsorption system which system is used to remove impurities from the air feed. In particular, the present invention is an improvement to said process for at least partially eliminating reductions in the purity of the product streams from the air separation unit caused by the intermittent diversion of the air feed as repressurization gas. The improvement comprises reducing the flow of both the nitrogen-enriched waste stream and the crude liquid oxygen stream from the air separation unit during those intermittent periods when repressurization gas is required in the pressure swing adsorption system.

DETAILED DESCRIPTION OF THE INVENTION

Figure 1:
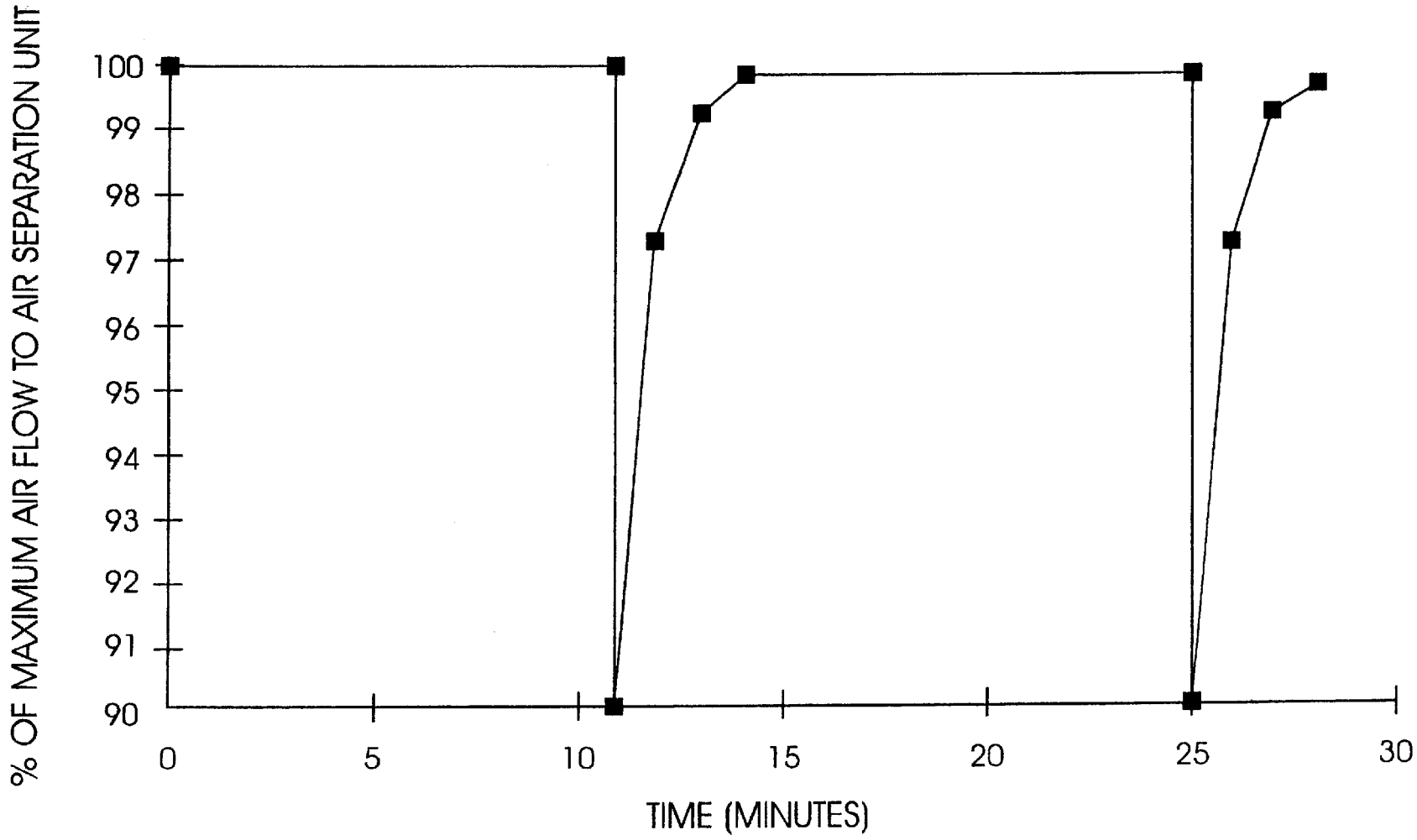
FIG. 1 is a graph illustrating the air flow disturbance to the air separation unit caused by intermittently diverting a portion of the air feed for the intermittently required repressurization gas in the front-end two bed pressure swing adsorption system.
Figure 2:
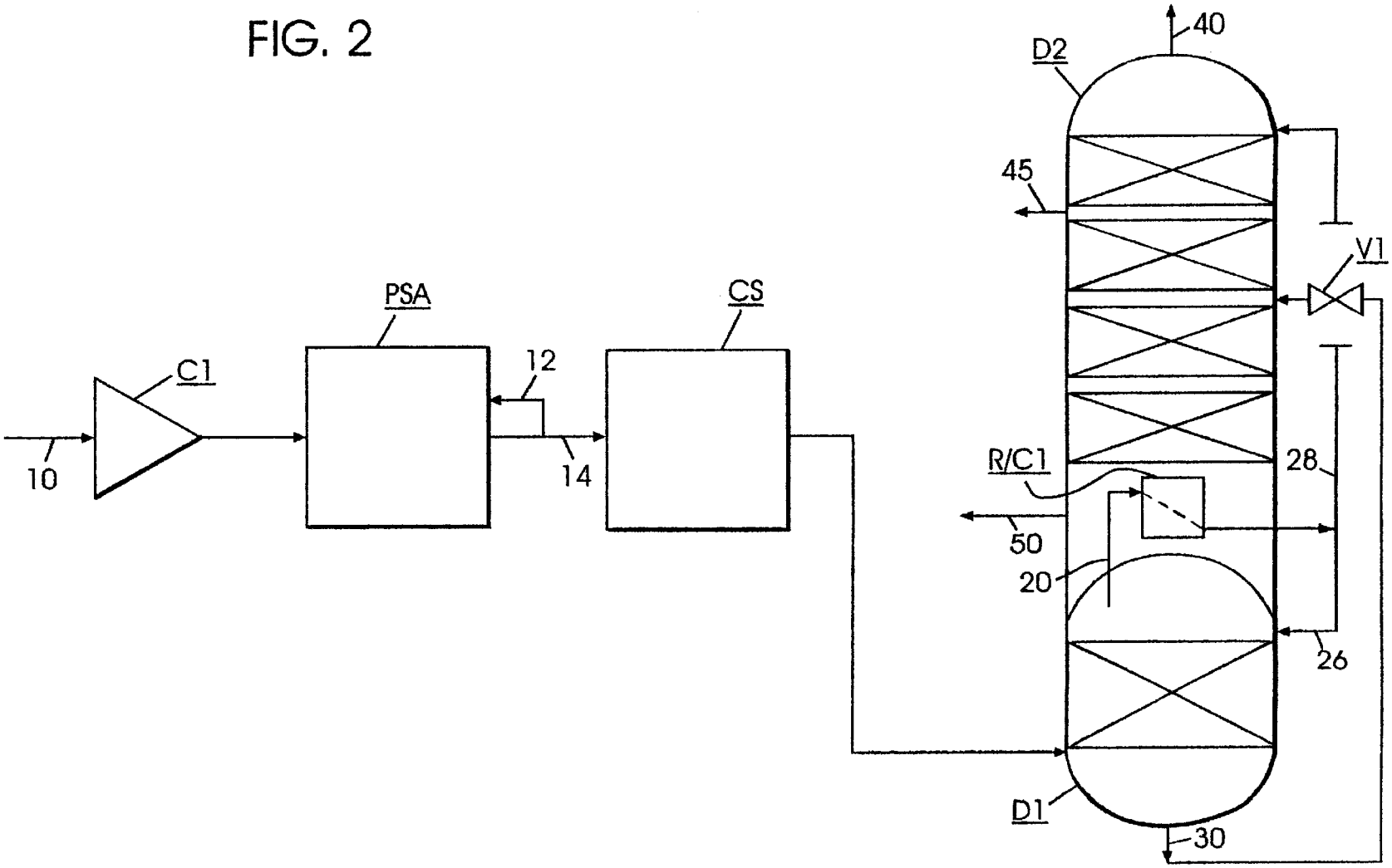
FIG. 2 is a schematic diagram of an air separation process to which the improvement of the present invention pertains.

The present invention is concerned with a prior art process as shown in FIG. 2. Referring now to FIG. 2, FIG. 2 is a process for the cryogenic distillation of an air feed [10] to produce a nitrogen-enriched waste stream [45] and product streams comprising a nitrogen rich stream [40] and an oxygen rich stream [50]. FIG. 2's process comprises the steps of:

(a) compressing the air feed [in compressor C1] to an elevated pressure;

(b) pretreating the compressed air feed in a two bed pressure swing adsorption system [PSA] to remove impurities comprising carbon dioxide and water to produce an impurity-depleted air feed wherein said two bed pressure swing adsorption system has an intermittent repressurization gas requirement which is satisfied by intermittently diverting a portion [12] of the impurity-depleted air feed;

(c) cooling the remaining portion [14] of the impurity-depleted air feed in a cooling system [CS] to a temperature near its dew point (the cooling system typically comprises a main heat exchanger in which the remaining portion [14] of the impurity-depleted air feed is cooled against the product streams);

(d) introducing the cooled, impurity-depleted air feed into a cryogenic distillation column system comprising a higher pressure column [D1] and a lower pressure column [D2] wherein:

(i) at least a portion of the cooled, impurity-depleted air feed is specifically fed to the higher pressure column;

(ii) the higher and lower pressure columns are thermally linked with a first reboiler/condenser [R/C1] which condenses a higher pressure nitrogen stream [20] from the top of the higher pressure column against a vaporizing oxygen rich liquid from the bottom of the lower pressure column; and (iii) a first portion [26] of the condensed higher pressure nitrogen stream is fed as reflux to an upper location in the higher pressure column while a second portion [28] thereof is fed as reflux to an upper location in the lower pressure column;

(e) removing a crude liquid oxygen stream [30] from the bottom of the higher pressure column, reducing the pressure of at least a first portion thereof [across valve V1] and feeding the reduced pressure portion to the lower pressure column wherein it is distilled into the nitrogen rich stream [40] which is removed from the top of the lower pressure column and the oxygen rich stream [50] which is removed from the bottom of the lower pressure column;

(f) removing the nitrogen-enriched waste stream [45] from an upper intermediate location of the lower pressure column;

The present invention is an improvement to FIG. 2's process for at least partially eliminating reductions in the purity of the product streams caused by intermittently diverting of a portion of the impurity-deleted air feed in step (b) for the intermittently required repressurization gas in the pressure swing adsorption system. The present invention's improvement comprises reducing the flow of both the nitrogen-enriched waste stream [45] removed in step (f) and the crude liquid oxygen stream [30] removed in step (e) during those intermittent periods when repressurization gas is required in the pressure swing adsorption system.

The present invention is especially useful where the distillation column system further comprises an argon sidearm column and wherein the product streams further comprise an argon rich stream produced by said argon sidearm column.

The present invention works by controlling internal vapor and liquid flows within the distillation columns during those periods when repressurization gas is required in the pressure swing adsorption (PSA) system in order to reduce disturbances to the ratio of liquid to vapor flow in the lower pressure column. This, in turn, at least partially eliminates reductions in the purity of the product streams. When repressurization gas is required, the flow of the nitrogen-enriched waste stream is reduced in order to maintain the pressure of the lower pressure column, despite a reduction in vapor flow through the lower pressure column. This is typically implemented by reducing the valve position for the nitrogen-enriched waste stream. Similarly, the flow of the crude liquid oxygen stream from the higher pressure column is reduced when repressurization gas is required. This is typically implemented by increasing the setpoint for the higher pressure column sump level controller such that the level in the higher pressure column sump is allowed to rise. The sump level is then allowed to fall gradually to the starting point, typically beginning at the time the repressurization step ends/the adsorption step begins and typically ending when the adsorption step ends/the depressurization step begins.

The skilled practitioner will appreciate that maintaining product purities during repressurization comes at the expense of a reduced average oxygen product flow and, to the extent an argon sidearm column is included, reduced average argon product flow. This reduction in product flows can be mitigated, however, by using a "feedfoward" control system to reduce the flows of the nitrogen-enriched waste stream and the crude liquid oxygen stream. In a feedfoward control system, the signals to (i) reduce the valve position for the nitrogen-enriched waste stream and (ii) increase the setpoint for the higher pressure column sump level controller are sent prior to, or simultaneous with, the signal that the repressurization gas flow has begun. (Contrast this with a "feedback" control system whereby said reduction in flows would be performed in reaction to the signal that the repressurization gas flow has begun.) Computer simulations have shown that the implementation of a feedforward control system vs. a feedback control system can increase the argon production by 6% of the total argon contained in the air to the distillation column system and increase the oxygen production by almost 1% of total oxygen contained in the air to the distillation column system. In these simulations, reduction of the valve position for the nitrogen-enriched waste stream was performed over a time period simultaneous with the time period for the represssurization gas flow. Meanwhile, the increase in the setpoint for the higher pressure column sump level controller was performed over a time period beginning slightly before the repressurization flow occurs in order to account for the inherent lag time between the time the setpoint for the higher pressure column sump level controller is increased and the time there is an actual reduction in the flow of the crude liquid oxygen being introduced into the lower pressure column.

What is claimed is:

1. In a process for the cryogenic distillation of an air feed to produce a nitrogen-enriched waste stream and product streams comprising a nitrogen rich stream and an oxygen rich stream, said process comprising the steps of:

(a) compressing the air feed to an elevated pressure;

(b) pretreating the compressed air feed in a two bed pressure swing adsorption system to remove impurities comprising carbon dioxide and water to produce an impurity-depleted air feed wherein said two bed pressure swing adsorption system has an intermittent repressurization gas requirement which is satisfied by intermittently diverting a portion of the impurity-depleted air feed;

(c) cooling the remaining portion of the impurity-depleted air feed in a cooling system to a temperature near its dew point;

(d) introducing the cooled, impurity-depleted air feed into a cryogenic distillation column system comprising a higher pressure column and a lower pressure column wherein at least a portion of the cooled, impurity-depleted air feed is specifically fed to the higher pressure column;

(e) removing a crude liquid oxygen stream from the bottom of the higher pressure column, reducing the pressure of at least a first portion thereof and feeding the reduced pressure portion to the lower pressure column wherein it is distilled into the nitrogen rich stream which is removed from the top of the lower pressure column and the oxygen rich stream which is removed from the bottom of the lower pressure column;

(f) removing the nitrogen-enriched waste stream from an upper intermediate location of the lower pressure column;

the improvement for at least partially eliminating reductions in the purity of the product streams caused by intermittently diverting of a portion of the impurity-deleted air feed in step (b) for the intermittently required repressurization gas in the pressure swing adsorption system, said improvement comprising reducing the flow of both the nitrogen-enriched waste stream removed in step (f) and the crude liquid oxygen stream removed in step (e) during those intermittent periods when repressurization gas is required in the pressure swing adsorption system wherein said reducing of the flow of both the nitrogen-enriched waste stream removed in step (f) and the crude liquid oxygen stream removed in step (g) is implemented by a feedforward control system whereby said reducing is performed prior to, or simultaneously with, the beginning of the intermittent periods when repressurization gas is required in the pressure swing adsorption system.

2. The process of claim 1 wherein the portion of the impurity-deleted air feed which is diverted as the intermittently required repressurization gas is diverted every eleven minutes for a period lasting three minutes and wherein, when diverted, constitutes 10% of the total impurity-deleted air feed at the beginning of such three minute period, gradually falling to 0% at the end of such three minute period.

3. The process of claim 1 wherein the higher and lower pressure columns are thermally linked with a first reboiler/condenser which condenses a higher pressure nitrogen stream from the top of the higher pressure column against a vaporizing oxygen rich liquid from the bottom of the lower pressure column.

4. The process of claim 3 wherein a first portion of the condensed higher pressure nitrogen stream is fed as reflux to an upper location in the higher pressure column while a second portion thereof is fed as reflux to an upper location in the lower pressure column.

5. The process of claim 1 wherein the cooling system comprises a main heat exchanger in which the remaining portion of the impurity-depleted air feed is cooled against the product streams.

* * * * *